US006679622B1

(12) United States Patent
Kao

(10) Patent No.: US 6,679,622 B1
(45) Date of Patent: Jan. 20, 2004

(54) FIBRE OPTIC LIGHTED ARTIFICIAL TREE

(75) Inventor: Cheung Chong Kao, Chai Wan (HK)

(73) Assignee: Boto (Licenses) Limited, Douglas (GB)

( * ) Notice: Subject to any disclaimer, the term of this patent is extended or adjusted under 35 U.S.C. 154(b) by 0 days.

(21) Appl. No.: 10/033,609

(22) Filed: Jan. 2, 2002

(51) Int. Cl.[7] ..... A41G 1/00
(52) U.S. Cl. ..... 362/567; 362/583; 362/123
(58) Field of Search ..... 362/122, 123, 362/283, 284, 293, 563, 564, 565, 567, 568, 583; 40/430, 431, 433, 435; 428/18, 19

(56) References Cited

U.S. PATENT DOCUMENTS 4,858,086 A * 8/1989 Pietrantonio et al. ..... 362/123
6,361,198 B1 * 3/2002 Reed ..... 362/568
6,431,740 B1 * 8/2002 Puleo ..... 362/123
6,438,879 B1 * 8/2002 Kao ..... 362/568

* cited by examiner

*Primary Examiner*—Y. My Quach-Lee
(74) *Attorney, Agent, or Firm*—Camille L. Urban; G. Brian Pingel

(57) ABSTRACT

A fibre optic lighted artificial tree that includes a base member, a trunk member and a plurality of branch members that are individually provided light from a separate fibre optic bundle and light source for each branch member. The tree also includes a top that is lighted by another fibre optic bundle and light source that are separate and apart from those associated with the branch members.

6 Claims, 8 Drawing Sheets

FIBRE OPTIC LIGHTED ARTIFICIAL TREE

BACKGROUND OF THE INVENTION

1. Field of the Invention

The present invention relates in general to lighted artificial trees and more specifically to artificial trees that are lighted by a fibre optic light source.

2. Description of the Prior Art

Lighted artificial trees such as Christmas trees have been known in the art for many years. With the advent of fibre optical bundles, artificial trees have been lighted in the past by use of a single bundle of optical fibre illuminated by a single lamp. Color provided to the optical fibre was changed by rotating a transparent color disk between the end of the optical fibre bundle and the lamp. Due to the limited illuminating range of the single lamp the number of optical fibre bundles incorporated in such structure was restricted, thus limiting the size of the Christmas tree employing such construction.

The present invention provides a plurality of tree branch members and a treetop that are each individually lighted through the use of an optical fibre bundle and a lamp. Consequently, the present invention facilitates the manufacture of taller and fuller optical fibre lighted artificial Christmas trees. In contrast to use of a color disk for changing the color provided to the tree branches, the present invention includes a rotating cylindrically shaped transparent color film that travels between the ends of the optical fibre bundles and the lamps for the tree branches.

SUMMARY OF THE INVENTION

The present invention provides a fibre optic lighted artificial tree that comprises a trunk member, a base member for supporting said trunk member in a vertical position, a plurality of tree branch members associated with the trunk member, and a first fibre optic light source means having a plurality of fibre optic bundles and light sources so that each tree branch member is lighted by a separate fibre optic bundle and light source.

In a preferred embodiment, the lighted tree includes a treetop member seated in a receptacle mounted on an upper portion of said trunk member and said branch members are attached to said receptacle to extend downwardly therefrom. The treetop member is associated further with a second fibre optic light source means formed of a fibre optic bundle and light source separate from those of the first light source means for providing light to said treetop.

The first light source means of the preferred embodiment further includes a first coloring means interposed between each of said fibre optic bundles and said light sources for said tree members to vary the color of the light supplied to the tree branch members. The second light source means preferably also includes a second coloring means for varying the color of the light supplied to said treetop.

Thus, it is an object of the present invention to provide illumination of an artificial tree in such fashion that the tree is not significantly limited in size or fullness due to the limitation of the light provided to the tree. Still further objects and advantages of the present invention will be apparent to those of ordinary skill in the art having reference to the following specification and the drawings which are described below.

DETAILED DESCRIPTION OF THE PREFERRED EMBODIMENT

Figure 1:
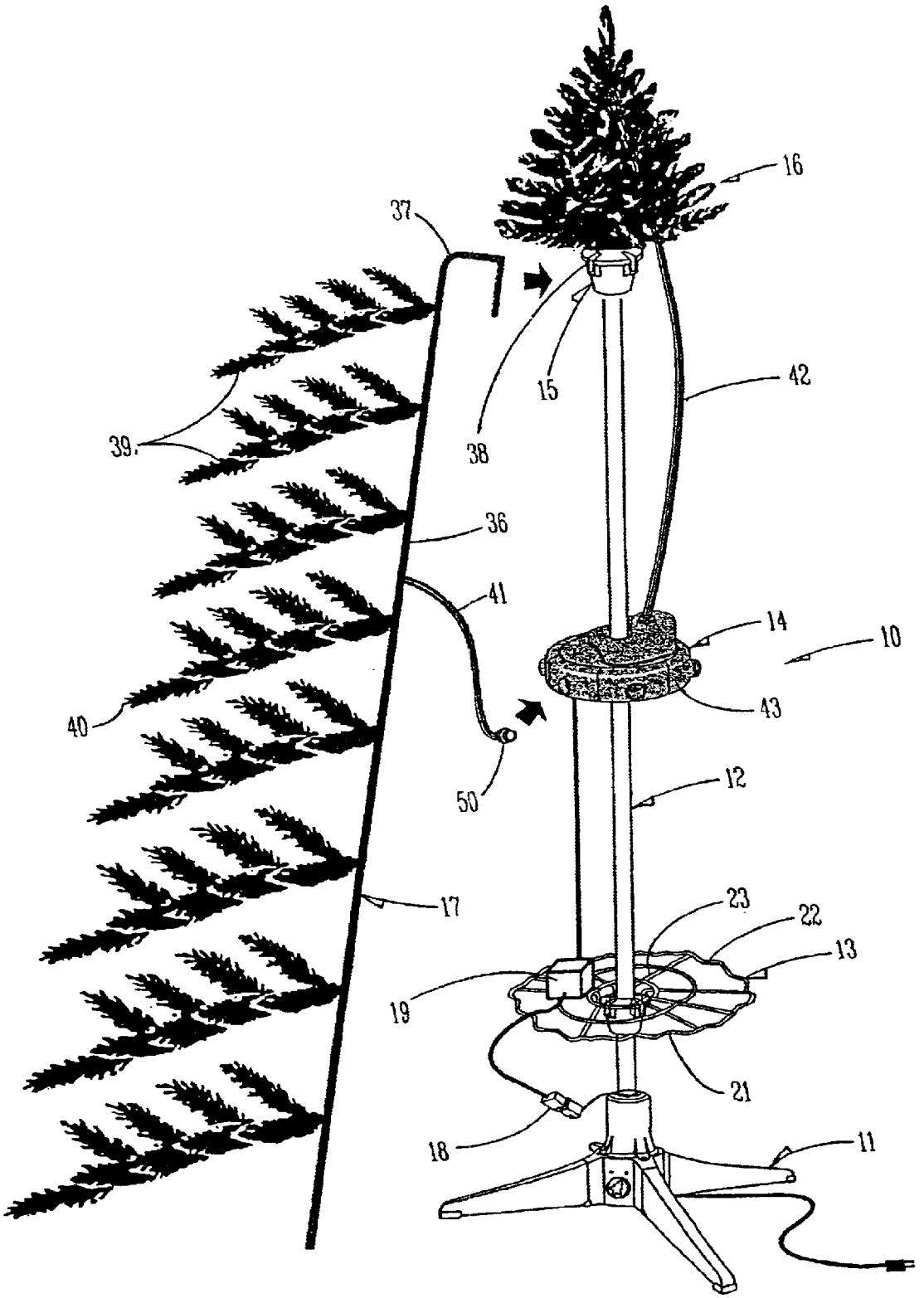
FIG. 1 is a reduced perspective view of a preferred embodiment of the fibre optic lighted tree of the present invention showing only one tree branch section for purposes of clarity.

Turning now to the drawings and with reference first to FIG. 1, a preferred embodiment of a fibre optic lighted artificial Christmas type tree of the present invention is shown at 10. The tree 10 is designed to provide an attractive alternative to the use of a natural Christmas tree as it can be assembled and lighted in just a matter of minutes. The principal components of tree 10 include a base 11 that supports an upstanding rod shaped trunk 12 on which are secured a wedge shaped frame member 13, a fibre optic light source assembly 14, a treetop mounting receptacle 15, a treetop 16 and a plurality of branch members 17 (only one of which is shown in FIG. 1).

The base 11 is preferably a rotating base as described in U.S. patent application Ser. No. 09/859,633, incorporated by reference herein, so as to provide rotational motion to the trunk 12 and the remainder of the tree 10. The lower end of the trunk 12 seats inside the base 11 and is secured thereto. The base 11 preferably has an AC electrical outlet 18 for providing electrical power to the light source assembly via an AC to DC converter 19.

Figure 2:
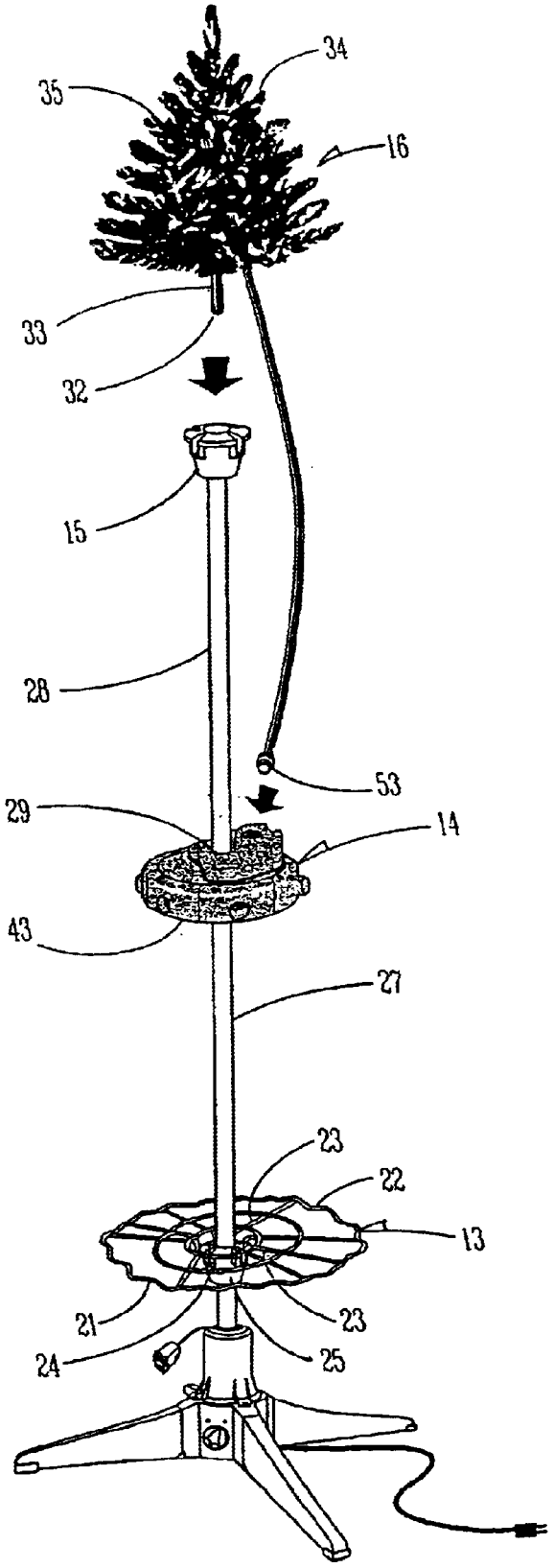
FIG. 2 is a reduced perspective view of the trunk and associated components thereto of the tree of FIG. 1 shown in an exploded format.

Referring now to FIG. 2, the frame member 13 is somewhat circularly shaped and is preferably formed of two semi-circular sections 21 and 22 for ease of assembly. Each of the sections 21 and 22 have downwardly extending fingers 23 that fit into cavities 24 of a frame holder 25 secured to the trunk 12 by adhesive or other such means. In the preferred embodiment, the trunk and frame member are formed from metal, whereas the frame holder is formed of a high strength plastic. However, it should be recognized by those skilled in the art that the particular materials from which the components of the tree 10 are formed is not a critical feature of the present invention.

The trunk 12 is formed of a lower section 27 and an upper section 28 that have adjacent ends that telescope together. The light source assembly 14 has a centrally aligned throughbore 29 that extends vertically through such assembly so that the trunk sections 27 and 28 can be inserted therein to be joined together to form the trunk 12 as will be described in further detail below.

The treetop receptacle 15 is mounted on the top end of the trunk upper section 28 and is designed for receiving the lower end 32 of a treetop trunk 33 for attaching the treetop 16 to the trunk 12. The treetop 16 is formed of the trunk 33 and has a plurality of branches 34 with artificial needles 35 to have an appearance quite similar to that of a natural conifer tree such as a pine, spruce or fir.

Referring again to FIG. 1, the main portion of the tree 10 is composed of branch members 17. Each of the branch members 17 is formed of an elongated preferably metal support rod 36 that has hook shaped upper end 37 that it is designed to be received into a cavity 38 in the treetop receptacle 15 and is supported by and suspended downwardly therefrom. The branch members 17 are held in an inclined position resting against the frame member 13 to provide the tree 10 with a cone shape similar to that of a natural conifer type tree. Secured to each support rod 36 of the branch members 17 are a plurality of conifer appearing branches 39 with needles 40 mounted on the support rods 36 in vertically aligned fashion to form the main body of the tree 10. Thus, by simply assembling the treetop 16 and the branch members 17 to the receptacle 15, the outer portion of the tree 10 can be readily and easily assembled together.

The light source assembly 14 is adapted to not only provide light to each of the branch members 17, but also to the treetop 16. As indicated in FIG. 1 each of branch members 17 has an associated fibre optic bundle 41 that is connectable to the assembly 14, as is known in the art, and is composed of a multitude of optic fibres that are distributed throughout the branches 39. Similarly, the treetop 16 has an associated fibre optic bundle 42 that is also attachable to the light source assembly 14 to provide optic fibres for lighting the treetop 16. Thus, in contrast to fibre optic lighted trees currently being manufactured and sold and having a single fibre optic bundle for lighting the entire tree, the present invention includes a plurality of fibre optic bundles that are supplied with light from the light source assembly to fully light the trunk and top section of the tree without significant limitation to its size as will now be described.

Figure 3:
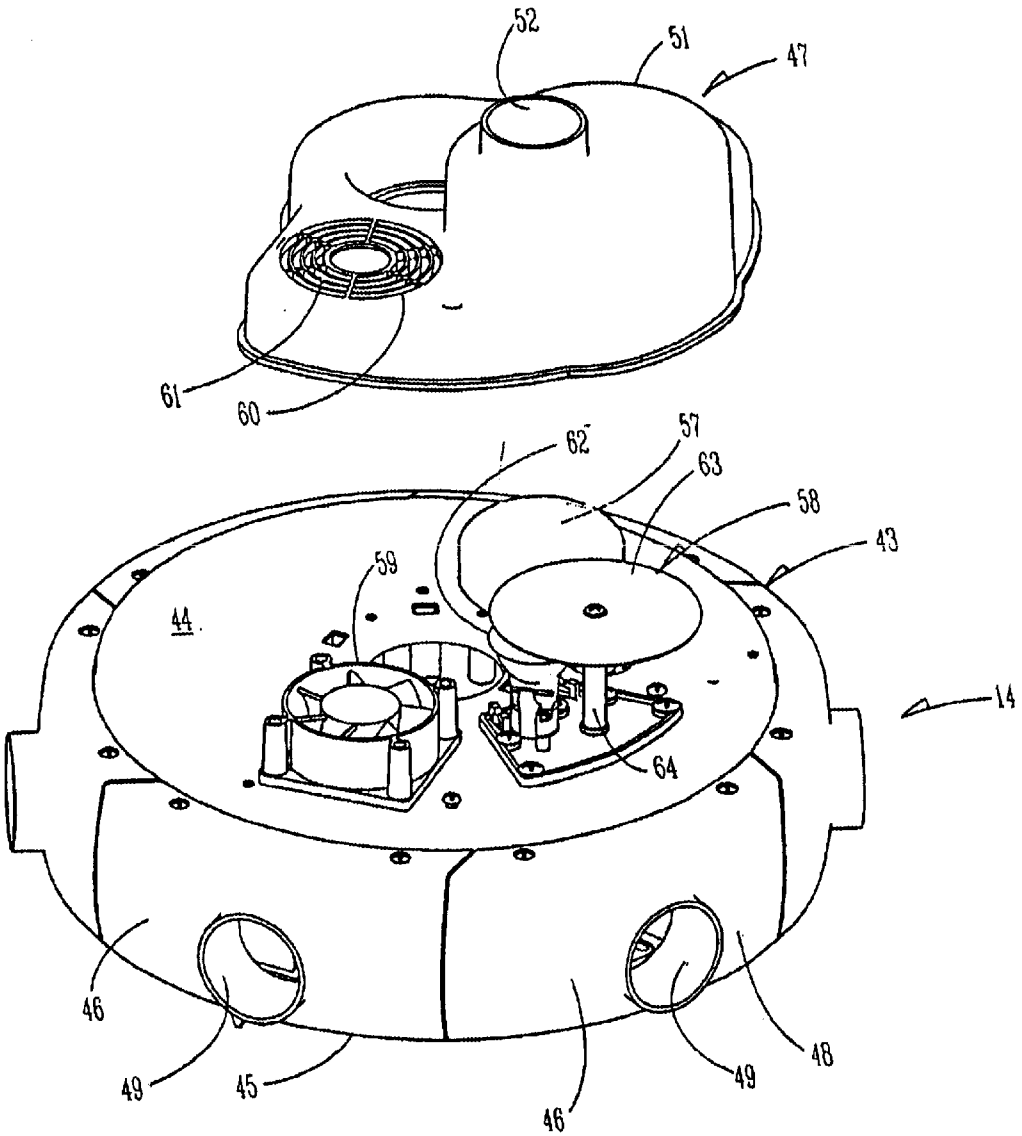
FIG. 3 is a perspective view of a light source assembly that is one of the components shown in FIG. 2, but with a top cover removed to expose interior components.

As indicated in both FIGS. 1 and 2, the light source assembly 14 has a substantially cylindrically shaped housing 43. Turning now to FIG. 3, the assembly housing 43 includes a top plate 44, a bottom plate 45 (shown in FIG. 4), a plurality of side plates 46 attached at opposite ends respectively to the plates 44 and 45 to form the sidewalls of the housing 43 and a top cover member 47 that is attachable to the top plate 44 as by screws or the like. A periphery 48 of the housing 43 has a plurality of spaced apart fibre optic ports 49, each for receiving an inner plug end 50 (see FIG. 1) of one of the branch member fibre optic bundles 41. Correspondingly, the top cover member 47 includes a domed portion 51 having a fibre optic bundle receiving port 52 for insertion of a plug end 53 (see FIG. 2) of the fibre optic bundle 42 associated with the treetop 16.

The cover member 47 serves as an enclosure for a motor 57, a light source 58 that supplies light to the fibre optic bundle 34 and a cooling fan 59 for exhausting heated air from the housing 43. As can clearly be seen in FIG. 3, the cover member 47 includes an opening 60 with a grille 61 that are associated with the cooling fan 59. The light source 58 is comprised of an electrical lamp 62 and a transparent color wheel 63 that is interposed between the lamp 62 and the port 52. The color wheel 63 is preferably comprised of sectors of different colors and is mounted on an axle 64 that is rotated as will be described below to vary the color of the light provided by the light source 58 to the fibre optic bundle 42. Together the light source 58 and the fibre optic bundle 42 form a light source means to supply light to the treetop 16.

Figure 4:
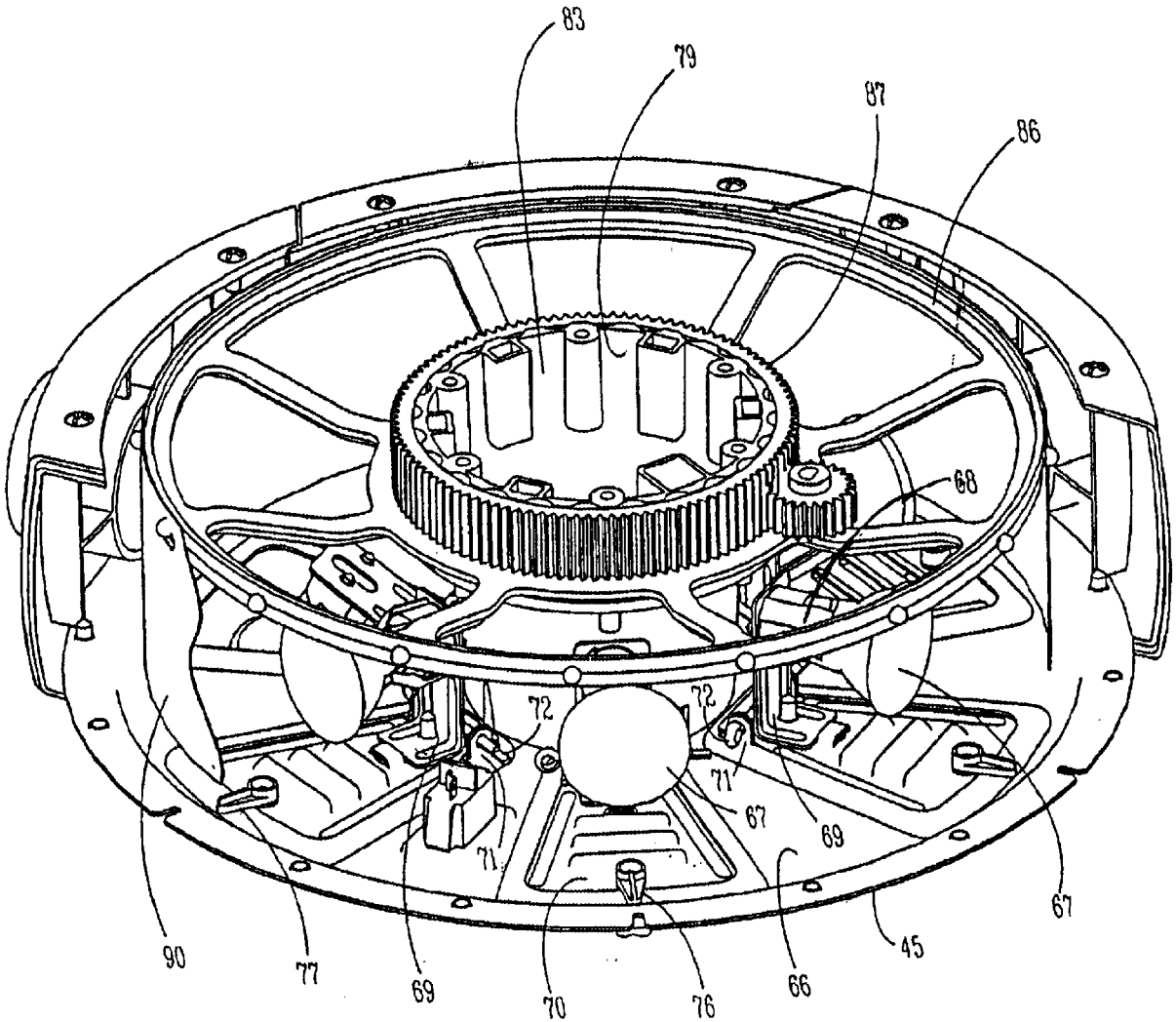
FIG. 4 is a perspective view of the light source assembly of FIG. 3 with the sides and top of its enclosure housing partially removed to expose interior components.
Figure 5:
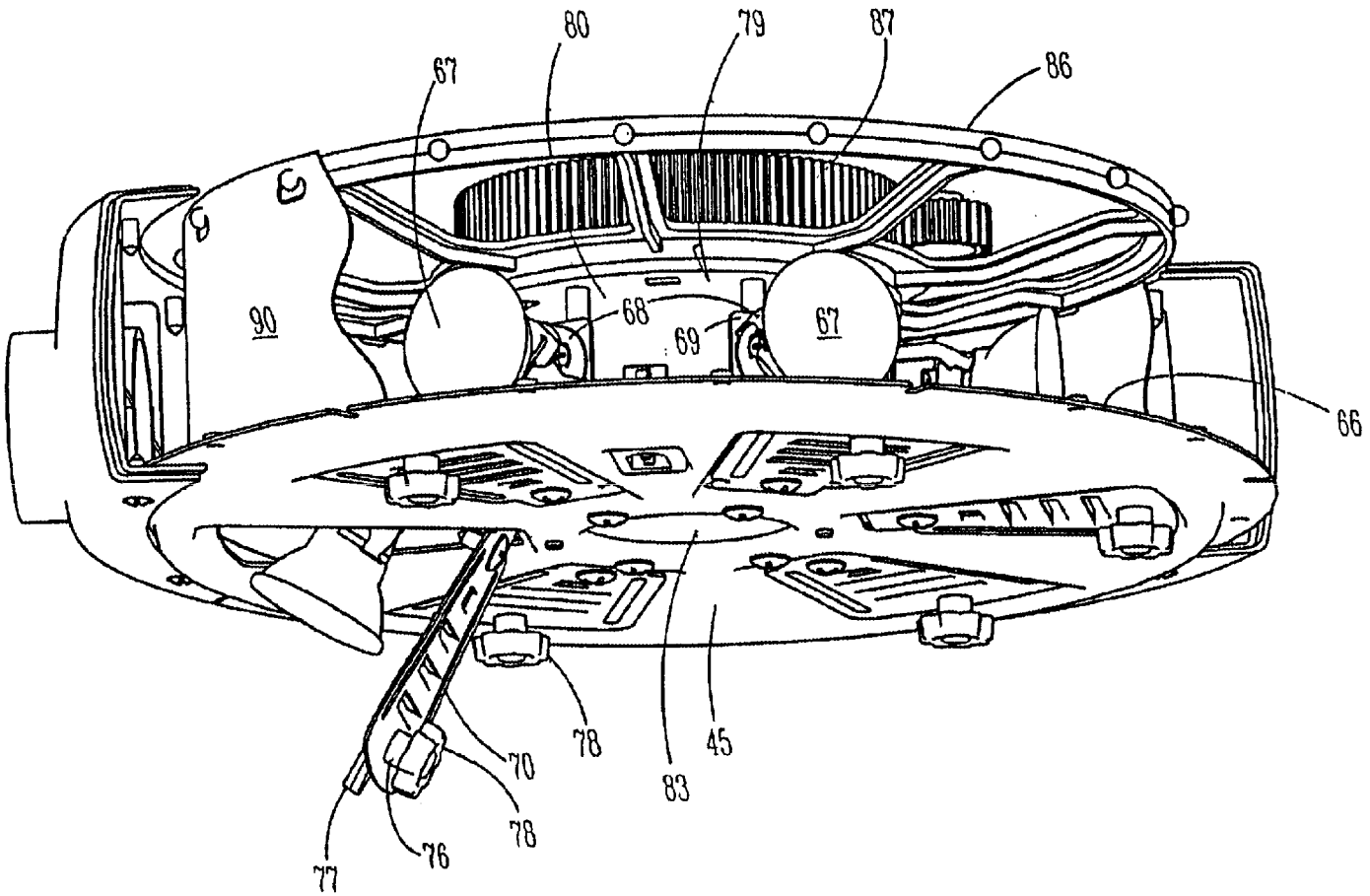
FIG. 5 is a perspective view somewhat similar to that of the FIG. 4 but taken from a different viewing angle and showing a lamp door of the light source assembly pivoted to an open condition.

Referring now to FIGS. 4 and 5, the interior surface 66 of the housing bottom plate 45 includes a plurality of lamps 67, each of which is associated with one of the optic light bundles 41 for the branch members 17. Each of the lamps 67 is disposed in a lamp socket 68 attached to an upstanding socket mount 69. Each of the mounts 69 are fastened to a lamp door 70 as by screws or the like. Each of the doors 70 is pivotally connected to the bottom plate 45 by trunions 71 and a cotter pin 72.

Normally, the lamp doors 70 are maintained in a closed condition by a door latch assembly 76 that is formed of a rotatable latch 77 located on the inner surface of the door 70 and a knob 78 on the outer surface thereof. However, if it is desired to change one of the lamps 67, this can easily be accomplished simply by rotating the latch 77 to release the door 76 associated with such lamp so that the door pivots into an open condition, as shown in FIG. 5, whereby its associated lamp 67 is easily accessible for being changed.

Figure 6:
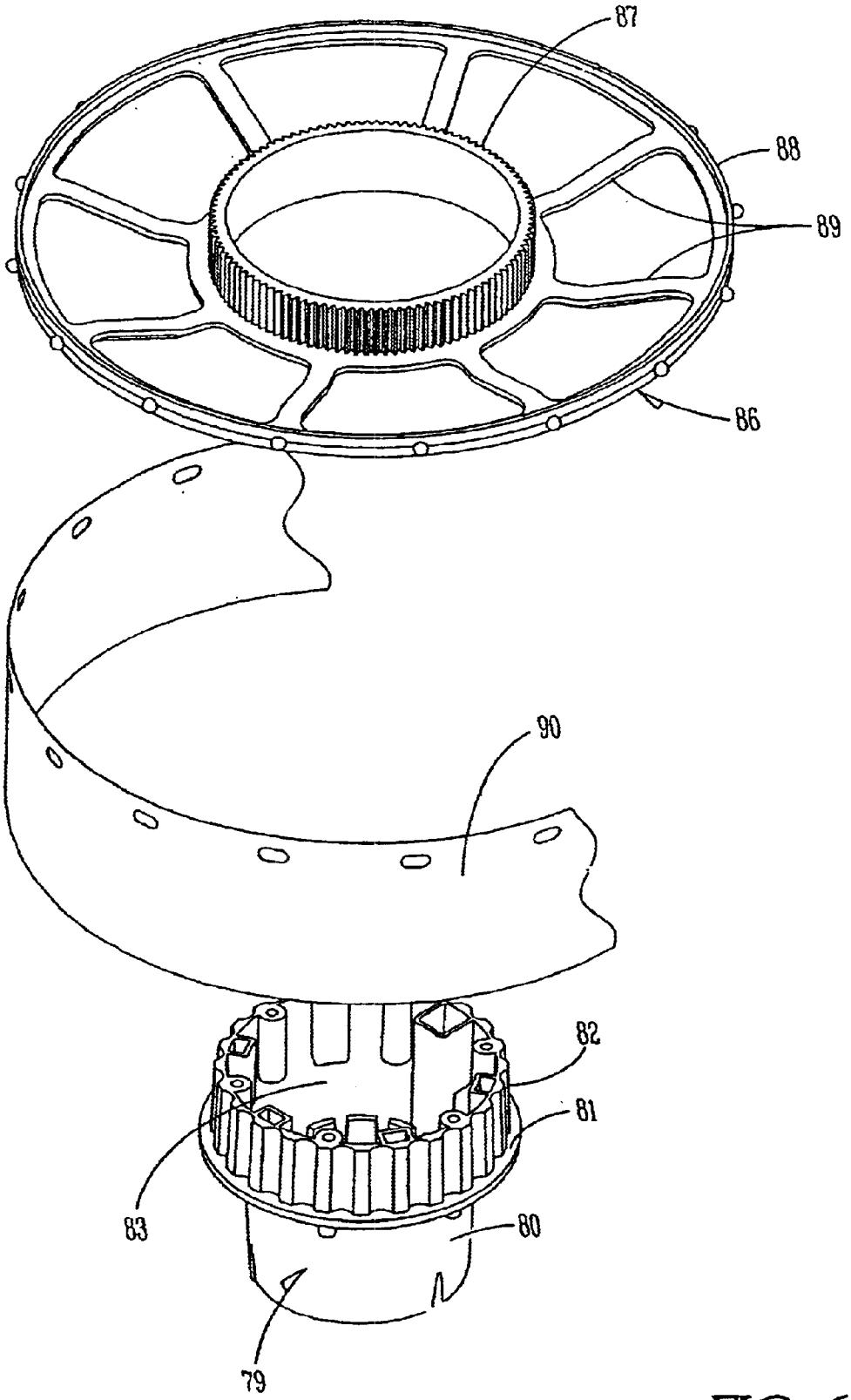
FIG. 6 is an exploded perspective view of a hub and a film wheel that forms a portion of the light source assembly of FIG. 3.

With reference now to FIGS. 4–7, positioned in the middle of and attached to the housing bottom plate 53 is a support hub 79 that has a tubular shaped bottom portion 80, a medial positioned flange portion 81 and an upper hub portion 82 (best shown in FIG. 6). A throughbore 83 is formed in the center of the hub 79 to allow the trunk 12 to extend therethrough. The throughbore 83 includes a bottom portion 84 (shown only in FIG. 8) that serves as a friction member to secure the hub 79 on the trunk 12. The bottom portion 84 is formed with upstanding struts 85 that are slightly inclined toward the center so that as the light source assembly 14 is slid onto the lower trunk section 27 the struts 85 engage the section 27 to snugly hold the light source assembly 14 in place on the trunk 12. The hub 79 serves as an axle for a film wheel 86 that is formed of a central gear section 87 and a rim portion 88 spaced from the gear section 87 by spokes 89.

Attached to the rim portion 88 of the film wheel 86 is a transparent color filmstrip 90 that extends downwardly therefrom. When the film wheel 86 is mounted on the top portion of the hub 79, as shown in FIGS. 4 and 5, the wheel 86 sits on the flange 81 and is rotatable with respect thereto. The film strip 90 extends downwardly from the wheel 86 to be interposed between the lamps 67 and their respective fibre optic bundle ports 49. Similar to the color wheel 63, the film strip 90 is formed with sections of different colors so that when the film wheel 86 is rotated with respect to the lamps 67, the color of the light provided to the branch members 17 varies from one color to another. Thus, the lamps 67, the film wheel 86 and the fibre optic bundles 41 serve as a light source means for the branch members 17.

Figure 7:
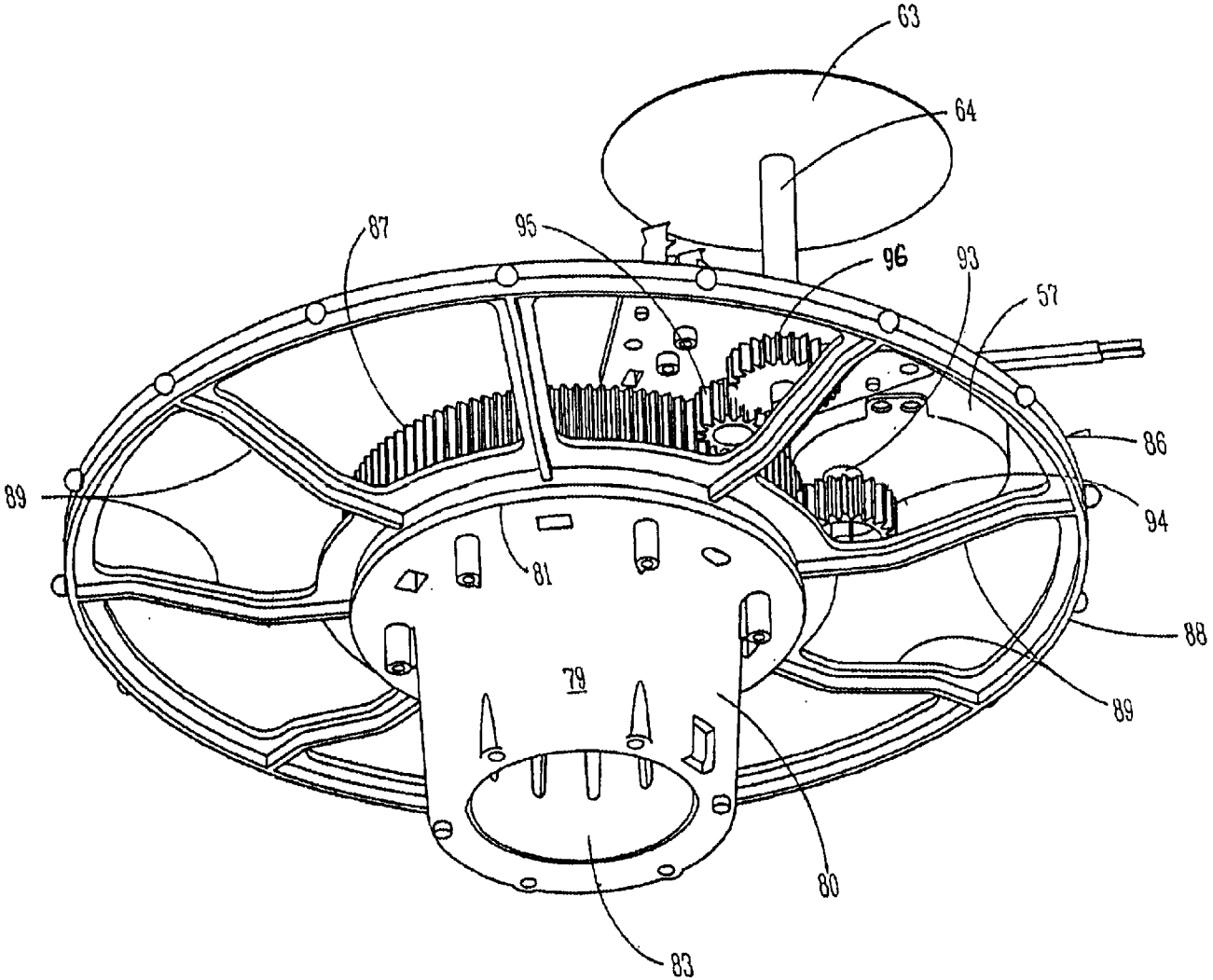
FIG. 7 is a perspective view of the hub and film wheel of FIG. 6 shown in association with an electrical motor and a gear train for providing drive power for the light source assembly of FIG. 3.
Figure 8:
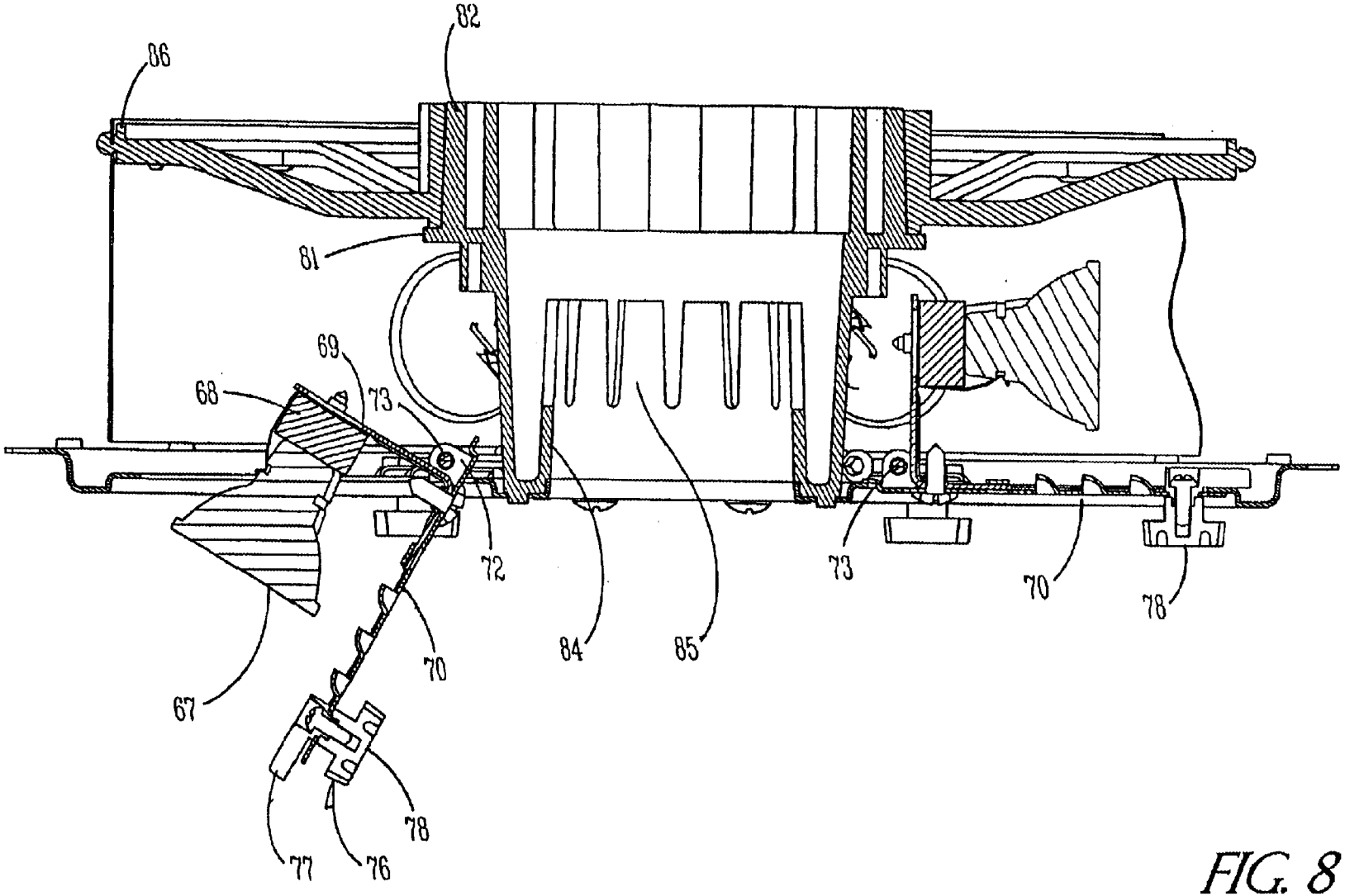
FIG. 8 is a cross-sectional view of the light source assembly of FIG. 3.

Driving action for the film wheel 86 is provided by the electric motor 57 mounted on the top plate 44 in the following manner. Referring now to FIG. 7, the motor 57 includes a drive axle 93 that extends downwardly into the housing 43. A pinion gear 94 is mounted on the drive axle 93 to mesh with and provide drive power to the gear portion 87 of the film wheel 86.

Drive power for the treetop color wheel 63 is provided through the use of an idle gear 95 that is in meshing relationship with the film wheel gear portion 87 and a second pinion gear 90 that is mounted on the axle 64 for the color wheel 63. The axle 64 extends upwardly through the housing top plate 44, as best shown in FIG. 3. Preferably, the color wheel 63 and the film wheel 86 are coordinated together, from a color standpoint, so that as such wheels are driven by the motor 57, the treetop 16 and the branch members 17 are all provided with the same colored light so that the tree 10 is simultaneously all one color.

Thus, the present invention provides a fibre optic lighted artificial tree that is not significantly limited in size or shape due to the use of multiple fibre optic bundles that are supplied from a plurality of light sources. Although the invention has been described with respect to a preferred embodiment thereof, it is to be understood that it is not to be so limited, since changes and modifications can be made therein, which are within the full intended scope of the invention as defined by the appended claims.

What is claimed is:

1. A fibre optic lighted artificial tree comprising:

(a) a base member;

(b) a trunk member supported in a vertical position by said base member;

(c) a plurality of tree branch members each associated with said tree trunk member to extend along side thereof;

(d) a fibre optic light source assembly having a first light source means for providing light to each branch member of said tree, said means having at least two fibre optic bundles and at least one light source associated with each of said bundles;

(e) said tree further includes a tree top member supported by an upper portion of said trunk member; and (f) said light source assembly further includes a second light source means for providing light to said tree top member.

2. A fibre optic lighted artificial tree comprising:

(a) a base member;

(b) a trunk member supported in a vertical position by said base member;

(c) a plurality of tree branch members each associated with said tree trunk member to extend along side thereof;

(d) a fibre optic light source assembly having a first light source means for providing light to each branch member of said tree, said means having at least two fibre optic bundles and at least one light source associated with each of said bundles;

(e) said tree further includes a tree top member supported by an upper portion of said trunk member;

(f) said light source assembly further includes a second light source means for providing light to said tree top member and said second light source means further includes a second coloring means interposed between a fibre optic bundle and a light source for said tree top member for varying the color of the light supplied to said tree top member.

3. A fibre optic lighted artificial tree comprising:

(a) a base member;

(b) a trunk member supported in a vertical position by said base member;

(c) a plurality of tree branch members each associated with said tree trunk member to extend along side thereof; and (d) a fibre optic light source assembly having a first light source means for providing light to each branch member of said tree, said means having at least two fibre optic bundles and at least one light source associated with each of said bundles; and (e) said light source assembly further includes a housing in which said light sources for said tree branch members are located, said housing having a plurality of pivoting panel portions, each associated with one of said light sources for said branch members to permit replacement of said light source in the event it ceases operation.

4. A fibre optic lighted artificial tree comprising:

(a) a base member;

(b) a trunk member supported in a vertical position by said base member;

(c) a plurality of tree branch members each associated with said tree trunk member to extend along side thereof; and (d) a fibre optic light source assembly having a first light source means for providing light to each branch member of said tree, said means having at least two fibre optic bundles and at least one light source associated with each of said bundles;

(e) said tree further includes a tree top member supported by an upper portion of said trunk member;

(f) said light source assembly further includes a second light source means for providing light to said tree top member;

(g) said second light source means further includes a second coloring means interposed between a fibre optic bundle and a light source for said tree top member for varying the color of the light supplied to said tree top member; and (h) said fibre optic bundle and light source for said tree top member are separate and apart from said fibre optic bundle and light source for each of said branch members of said tree.

5. A fibre optic lighted artificial tree comprising:

(a) a base member;

(b) a trunk member supported in a vertical position by said base member;

(c) a plurality of tree branch members each associated with said tree trunk member to extend along side thereof;

(d) a fibre optic light source assembly having a first light source means for providing light to each branch member of said tree, said means having at least two fibre optic bundles and at least one light source associated with each of said bundles;

e) said first light source means further includes a first coloring means interposed between each of said fibre optic bundles and said light sources for varying the color of the light supplied to said tree branch members;

(f) said light source assembly further includes a tree top member supported by an upper portion of said trunk member, a second light source means having a second coloring means interposed between a fibre optic bundle and a light source for said tree top member for varying the color of the light supplied to said tree top member, and a motor means for rotating said first and second coloring means to vary the color of the light supplied to said branch members and said tree top member; and (g) said first coloring means is formed of a wheel shaped frame member rotatable by said motor means and having a colored film attached to its outer periphery so that as said frame member is rotated said colored film is moved with respect to said light sources for said tree branch members.

6. A fibre optic lighted artificial tree comprising:

(a) a base member;

(b) a trunk member supported in a vertical position by said base member;

(c) a plurality of tree branch members each associated with said tree trunk member to extend along side thereof;

(d) a fibre optic light source assembly having a first light source means for providing light to each branch member of said tree, said means having at least two fibre optic bundles and at least one light source associated with each of said bundles;

(e) said first light source means further includes a first coloring means interposed between each of said fibre optic bundles and said light sources for varying the color of the light supplied to said tree branch members; and (f) said light source assembly further includes a tree top member supported by an upper portion of said trunk member, a second light source means having a second coloring means interposed between a fibre optic bundle and a light source for said tree top member for varying the color of the light supplied to said tree top member, and a motor means for rotating said first and second coloring means to vary the color of the light supplied to said branch members and said tree top member.

* * * * *